US005195295A

United States Patent [19]

Kurosaki

[11] Patent Number: 5,195,295

[45] Date of Patent: Mar. 23, 1993

[54] METHOD OF FABRICATING PACKED ARTICLE OF MULTI-STORIED LAYERS OF BOX-LIKE PACKAGES

[75] Inventor: Satoshi Kurosaki, Shizuoka, Japan

[73] Assignee: San-Ei Regulator Co., Ltd., Shizuoka, Japan

[21] Appl. No.: 792,303

[22] Filed: Nov. 14, 1991

[30] Foreign Application Priority Data

Nov. 15, 1990 [JP] Japan ..... 2-307087

[51] Int. Cl.[5] ..... B65B 5/06; B65B 13/02; B65B 27/02

[52] U.S. Cl. ..... 53/399; 53/447

[58] Field of Search ..... 53/399, 443, 447, 446, 53/448

[56] References Cited

U.S. PATENT DOCUMENTS

| | | | |
|---|---|---|---|
| 2,961,810 | 11/1960 | Johnson et al. | 53/447 X |
| 3,189,175 | 6/1965 | Cruckshank | 53/447 X |
| 3,246,744 | 4/1966 | Marnon | 53/399 X |
| 3,356,013 | 12/1967 | Konger | 53/399 X |
| 3,895,476 | 7/1975 | Burns, III | 53/447 X |
| 4,060,957 | 12/1977 | Birkenfeld et al. | 53/447 X |

*Primary Examiner*—Horace M. Culver
*Attorney, Agent, or Firm*—Tarolli, Sundheim & Covell

[57] ABSTRACT

A method for producing a packed article of a plurality of box-like packages having the same dimension is provided. The method comprising the steps of: forming a first layer of packages by arranging a plurality of box-like packages in a predetermined pattern; forming upper layers of packages, each upper layers including the same number of the packages as that of said first package and having the same pattern as that of said first layer; forming an intermediate layer of packages, said intermediate layer including number of packages less than that of said first layer or said upper layers; and disposing said intermediate layer between said first layer and the upper layer adjacent to said first layer so as to form spaces on opposite sides of said intermediate layer.

9 Claims, 2 Drawing Sheets

METHOD OF FABRICATING PACKED ARTICLE OF MULTI-STORIED LAYERS OF BOX-LIKE PACKAGES

BACKGROUND OF THE INVENTION

1. Field of the Invention

This invention relates to a method for fabricating a packed article of multi-storied layers of box-like packages, such as a carton box containing therein toilet papers and tissue papers.

2. Description of the Prior Art

A palletless, packed article consisting of stacked layers of packages (palletless packed article) is known in the art as shown in Japanese Patent Publication No. 57-13448 and Japanese Patent Public Disclosure Nos. 60-34351 and 60-77875.

such a conventional packed article includes a first stage layer 1 and a plurality of upper stage layers 2 stacked on the first stage layer 1, as shown in FIG. 5. The first stage layer 1 has a width less than that of the upper stage layers 2 so as to define spaces, 3, 3 on each side of the first stage layer 1 and below the lower surface of the second stage layer 2. Thus, a fork arm of a forklift truck is permitted to be inserted into and disengaged from the right and left spaces 3, 3.

The above construction permits a fork arm of a forklift truck to be inserted into the right arm and left spaces so as to handle or transport a package without the use of a pallet.

It will be appreciated, however, that, in order to bring the stacked layers into a unitary packed article, it is necessary for all layers to be wound up by a length of band or a strip of sheet 4. When so wound up, a portion 4' of a length of band or a strip of sheet 4 extends diagonally across the spaces 3, 3 between a right or left lower edge of the first stage layer 1 and a right or left lower edge of the second stage layer 2. This may interfere with insertion or disengagement of a fork arm relative to the spaces 3, 3.

In order to avoid the above deficiency, it is necessary to bend portions 4' of the band or sheet, which otherwise extends across the right and left spaces, in a right angle, as shown by phantom lines in FIG. 5. The portions having been so bent are then adhesively attached to the lower surface 2', 2' of the right and left side surface of the second stage layers and to the right and left side surface 1', 1' of the first stage layer. This procedure is time consuming and troublesome. It is also required to determine the necessary length of the band or sheet 3 by allowing for the length of the portions of the belt of the like which would be adhesively attached to lower surface 2' and the side surface 1'. Furthermore, the belt or sheet should initially be wrapped around the entire layers in a loose manner. This may cause collapsing of the box-like packages.

SUMMARY OF THE INVENTION

In view of the disadvantages experienced in the prior art palletless packed article, the present invention is intended to provide a palletless packed article of multi-storied layers of packages which includes right and left spaces relative to which a fork arm of a forklift truck can be engaged or disengaged.

A palletless packed article in accordance with the present invention comprises a first stage layer including a plurality of box-like packages of the same dimension arranged in a desired manner, upper stage layers superposed on the first stage layer and including the same number and the same dimension of the box-like packages as those in the first stage layer, the box-like packages being arranged in the same manner as those in the first stage layer, and an intermediate layer interposed between the first layer and the upper layers and including a plurality of box-like packages of the same dimension as those in the first and upper layers, the number of the box-like packages in the intermediate layer being less than that in the first layer or upper layers, the box-like packages in the intermediate layer being arranged in a manner different to that in the first layer or upper layers so as to form a single layer having a width smaller than that of the first layer or upper layers, the first, upper and intermediate layers being packed together.

In accordance with one preferred embodiment of the present invention, the intermediate layer of a smaller width is superposed on the first stage layer and the upper stage layers is then superposed on the intermediate layer.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENT

Figure 1:
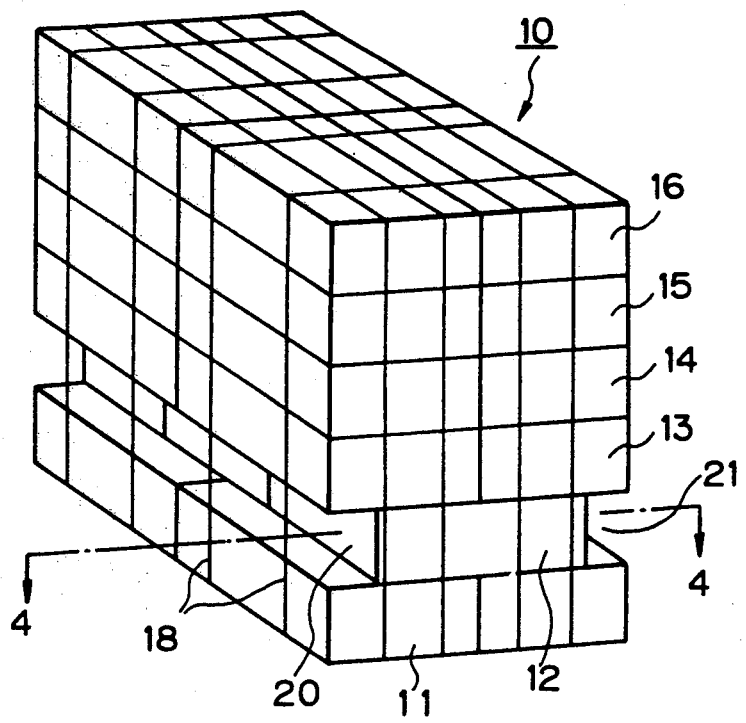
FIG. 1 is a perspective view of a packed article constructed in accordance with one embodiment of the present invention.

Referring to the drawings, a palletless packed article of multi-stored layers of packages 10 constructed in accordance with the invention comprises a first stage layer 11, upper stage layers 13–16 and an intermediate layer 12 of a smaller width. The intermediate layer 12 is superposed on the first stage layer 11. The upper layers 13–16 consisting of four layers stacked vertically are superposed on the intermediate layer 12. All of the six layers 11–16 are packed together by means of a length of band 14 wrapped therearound. Spaces or channels 20, 21 for allowing insertion thereinto and disengagement therefrom of a fork arm of a forklift truck are formed between the upper surface of the first stage layer 11 and the lower surface of the intermediate stage layer 13.

Figure 2:
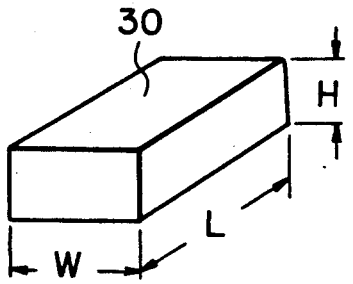
FIG. 2 is a perspective view of one of the box-like packages constituting each layers of the packed article shown in FIG. 1.

Each of the layers 11, 12, 13, 14, 15 and 16 are constituted by a plurality of box-like carton made packages of the same dimension, such as packages containing toilet papers and tissue papers. The dimension of the packages is, for example, 700 mm in length, 470 mm in width and 240 mm in height (see FIG. 2).

Figure 3:
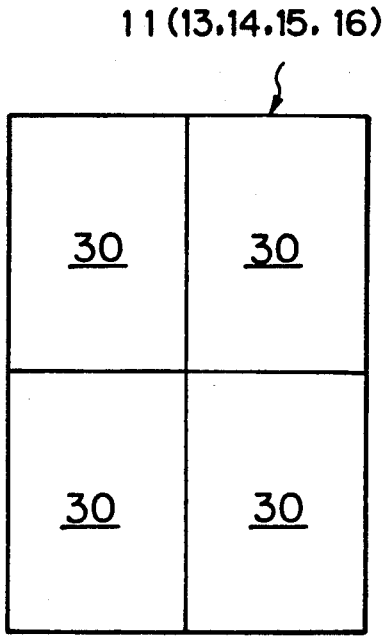
FIG. 3 is a plan view of the first stage layer and upper stage layers shown in FIG. 1.

The first layer 11 and the upper layers 13–16 each are constituted by arranging the box-like packages in two columns with two rows. The plan view of each of the first layer and upper layers represents a rectangle having the long sides (length) of 700×2=1400 mm and the short sides (width) of 470×2=940 mm (see FIG. 3).

Figure 4:
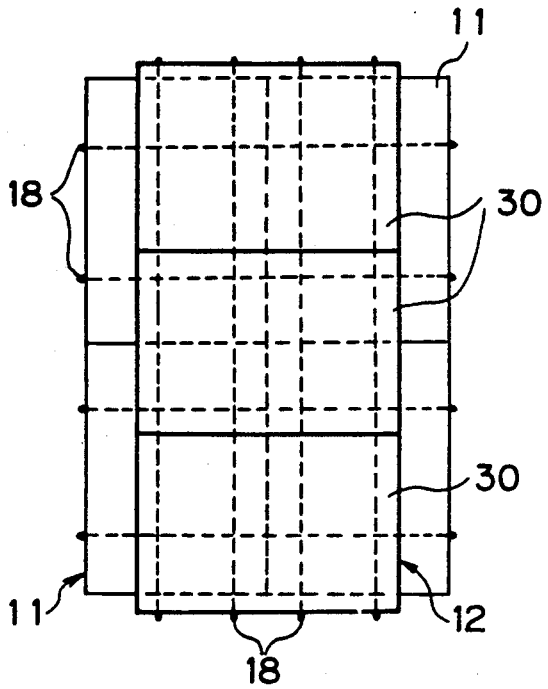
FIG. 4 is a cross-sectional view taken along line 4—4 in FIG. 1.
Figure 5:
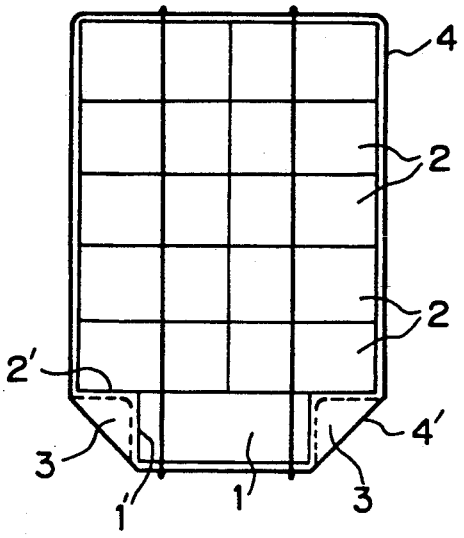
FIG. 5 is a front elevational view of prior art packed article.

The intermediate layer 12 includes three-box-like packages arranged in a row with their long sides being adjacent each other. The plan view of the intermediate layer 12 represents a rectangle having the long sides (length) of 470×3=1410 mm and the short sides (width) of 700 mm (see FIG. 4).

The intermediate layer 12 is superposed on the first layer 11 with the long sides and the short sides aligned respectively with the long sides and the short sides of the first layer. With this regard, it should be noted that the intermediate layer 12 is disposed on the first layer so that the geometrical center of the rectangle of the intermediate layer 12 is aligned with that of the rectangle of the first layer 11. The four upper layers 12, 14, 15 and 16 are then superposed on the intermediate layer 12. All of the layers are packed together by means of a length of band 18. Thus, the packed article 10 is constituted by twenty-three (23) box-like packages.

The packed article 10 as constructed above includes two spaces 20 and 21 defined between the lower surface of the upper layer 13 and the upper surface of the first layer 11 on the opposite sides of the intermediate layer 12. The width of each of the spaces is 120 mm, i.e., one half of the difference between the short side of the upper layer 13, i.e., 940 mm and the short side of the intermediate layer 12, i.e., 700 mm. The height of each of the spaces, 20, 21 simply corresponds to the height of the package, i.e., 240 mm. The length of each of the spaces 20, 21 corresponds to the length of the intermediate layer, i.e., 1410 mm. A length of band 18, when wrapped around the packed article, extends outwardly of the spaces 20, 21, and thus it would not interfere with insertion and disengagement of a fork arm of a forklift truck relative to the spaces 20, 21.

Each package 30 of the intermediate layer 12 partially overlays at least two of the packages 30 of the first layer 11. Some or all of the packages 30 of the first layer 11 are only partially overlaid by the packages 30 of the intermediate layer 21. Each package 30 of the intermediate layer 21 is overlaid by at least two of the packages 30 of the upper layer 13. Some or all of the packages 30 of the upper layer 13 partially overhang some of the packages 30 of intermediate layer 21. This arrangement provides stability for the packed article 10 and permits the packages 30 to frictionally engage and support each other.

In the embodiment described just above, the first layer 11 and the upper layers 13–16 each are constituted by four packages 30 and the intermediate layer is constituted by three packages 30 so as to make the long sides of the first layer and upper layers substantially the same as that of the intermediate layer 12, and so as to form the spaces 20 and 21 on the opposite sides of the intermediate layer. It should be noted, however, that, depending upon dimension of box-like packages to be used, the number of the box-like packages, as well as arrangement thereof, can be changed. Furthermore, and when box-like packages having relatively low profile, i.e., smaller height, are to be used and it is expected that a single intermediate layer would not provide spaces sufficient to allow access of a fork arm thereinto, the intermediate layer 12 can be constituted by multi-storied layers.

It should also be noted that a sheet material can be used instead of a length of band 18 so as to pack the layers together. Although it is preferred that the intermediate layer be disposed between the first layer 11 and the upper layer 13, the intermediate layer 12 may be disposed between the upper layers 13–16.

In accordance with the present invention, an intermediate layer of a smaller width is disposed between the first layer and the lowest upper layer or between any two of the upper layers. The intermediate layer defines spaces on opposite sides thereof. The spaces allow insertion and disengagement of a fork arm of a forklift truck relative thereto with no interference. This obviates time-consuming and troublesome procedures to be taken in order to prevent the spaces being interfered with a length or sheet. Accordingly, the present invention facilitates efficient fabrication of a palletless packed article of multi-storied layers of packages.

From the above description of a preferred embodiment of the invention, those skilled in the art will perceive improvements, changes and modifications. Such improvements, changes and modifications within the skill of the art are intended to be covered by the appended claims.

What is claimed is:

1. A method for producing a packed article of a plurality of box-like packages having the same dimension, said method comprising the steps of:

forming a first layer of packages by arranging a plurality of packages in a predetermined pattern with a predetermined width;

forming an upper layer of packages, the upper layer including the same number of packages as that of the first layer and having the same pattern and width as that of the first layer;

forming an intermediate layer of packages, said intermediate layer including a number of packages less than that of the first layer and having a width less than that of the first layer;

disposing the intermediate layer between the first layer and the upper layer adjacent to the first layer such that each of the packages of the intermediate layer partially overlays at least two of the packages of the first layer and some of the packages of the first layer are only partially overlaid by the packages of the intermediate layer and such that each of the packages of the intermediate layer is overlaid by at least two of the packages of the upper layer and some of the packages of the upper layer partially overhang some of the packages of the intermediate layer to form spaces on opposite outer sides of said intermediate layer; and binding the first, intermediate and upper layers together with binding material.

2. A method as set forth in claim 1, wherein said step of binding the first, intermediate and upper layers together includes tightening the binding material so that the binding material extends from the first layer to the upper layer, across the spaces.

3. A method as set forth in claim 1, wherein said step of binding the first, intermediate and upper layers together includes tightening the binding material so that the binding material does not engage the opposite outer sides of the intermediate layers.

4. A method as set forth in claim 1, wherein the binding material includes binding bands which extend around the packed article such that the longitudinal extents of the spaces are unobstructed.

5. A method as set forth in claim 1, wherein said step of forming a first layer includes positioning four packages into a two column, two row array, said step of forming an upper layer includes positioning four packages into a two column, two row array, said step of forming an intermediate layer includes positioning three packages into a row, said step of disposing the intermediate layer between the first layer and the upper layer adjacent to the first layer includes positioning the intermediate layer relative to the first layer and the upper layer such that a longitudinal extent of each package of the intermediate layer extends in a direction substantially perpendicular to the longitudinal extent of each package of the first layer and the upper layer.

6. A method for producing a packed article of a plurality of box-like packages having the same dimension, said method comprising the steps of:

forming a first layer of packages by arranging a plurality of box-like packages in a predetermined pattern with a predetermined width;

forming upper layers of packages, each of the upper layers including the same number of packages as that of the first layer and having the same pattern and width as that of the first layer;

forming an intermediate layer of packages, said intermediate layer including a number of packages less than that of the first layer and having a width less than that of the first layer;

forming a multi-layer stack of the plurality of articles with channels which extend along the length of opposite sides of the outer periphery of the stack for receiving fork arms, including disposing the intermediate layer between the first layer and the upper layers adjacent to the first layer such that opposite sides of the outer periphery of the intermediate layer is recessed with respect to opposite sides of the outer peripheries of the first and upper layers, each respective first side of the opposite sides of the first and upper layers being coplanar, each respective second side of the opposite sides of the first and upper layers being coplanar, thereby defining the channels; and binding the multi-layer stack together with binding material which engages the first layer, transverses the channels and engages the upper layers to cause the first, intermediate and upper layers to be directly engaged together to prevent relative movement of the first, intermediate and upper layers.

7. A method as set forth in claim 6, wherein said step of forming a multi-layer stack includes disposing a lowest layer of the upper layers adjacent the intermediate layer such that each package of the lowest layer of the upper layers at least partially overlays at least one of the packages of the intermediate layer to prevent relative movement of the plurality of packages.

8. A method as set forth in claim 7, wherein said step of forming a multi-layer stack includes disposing the intermediate layer such that each of the packages of the first layer is at least partially overlaid by a package of the intermediate layer to prevent relative movement of the plurality of packages.

9. A method as set forth in claim 6, wherein said intermediate layer is superposed on said first layer and said upper layers are disposed above said intermediate layer.

* * * * *